US005356318A

United States Patent [19]

Fry et al.

[11] Patent Number: 5,356,318

[45] Date of Patent: Oct. 18, 1994

[54] CONDUCTOR CRIMPING ELECTRICAL TERMINAL

[75] Inventors: Rupert J. Fry, Des Plaines; Robert A. Klemmer, Wheaton; Gary E. Polgar, Bolingbrook; Russell E. Wende, Oak Lawn, all of Ill.

[73] Assignee: Molex Incorporated, Lisle, Ill.

[21] Appl. No.: 136,633

[22] Filed: Oct. 14, 1993

[51] Int. Cl.[5] ..... H01R 4/18

[52] U.S. Cl. ..... 439/877

[58] Field of Search ..... 439/877, 879-882, 439/865-868

[56] References Cited

U.S. PATENT DOCUMENTS

| | | | |
|---|---|---|---|
| 3,112,150 | 11/1963 | Hammell | 439/882 |
| 3,275,423 | 9/1966 | Klumpp, Jr. | 439/877 |
| 4,691,437 | 9/1987 | Vaglini | 29/753 |
| 4,861,280 | 8/1989 | Piana et al. | 439/491 |

FOREIGN PATENT DOCUMENTS 0356168 8/1988 European Pat. Off. .

*Primary Examiner*—Gary F. Paumen

*Attorney, Agent, or Firm*—Stephen Z. Weiss

[57] ABSTRACT

An elongated sheet metal terminal is adapted to be crimped onto an exposed conductor of an electrical wire, the conductor having a given cross-sectional area. The terminal defines a longitudinal axis and includes a mating end, a terminating end and a transition section therebetween. The terminating end has a pair of spaced crimped walls, and the transition section has a pair of spaced transition walls joining the crimp walls to the mating end. The transition section has a minimum cross-sectional area at any given axial location of at least sixty-five percent of the given cross-sectional area of the conductor. The crimp walls are adapted to be completely curled into generally semi-cylindrical configurations into crimping engagement with the conductor. The transition walls are adapted to be partially curled into generally semi-frusto-conical configurations toward the conductor.

4 Claims, 4 Drawing Sheets

CONDUCTOR CRIMPING ELECTRICAL TERMINAL

FIELD OF THE INVENTION

This invention generally relates to the art of electrical connectors and, particularly, to a connector terminal which has walls for crimping onto the conductor of an electrical wire.

BACKGROUND OF THE INVENTION

One type of terminal for terminating an electrical wire within a connector, generally, is an elongated sheet metal terminal adapted to be crimped onto an exposed conductor of the electrical wire. The terminal includes a mating end, a terminating end and a body or transition section therebetween. The terminating end usually includes two pairs of crimp walls. One pair of walls crimps onto the outer cladding or insulation of the electrical wire, and the other pair of walls crimps onto the exposed conductor of the wire. The transition section includes a base wall which is common to a bottom wall between the crimp walls to define a generally U-shaped configuration. The transition section may include side walls coplanar with the conductor crimp walls, but the side walls of the transition section are relatively short and not as extensive as the crimp walls, because the sheet metal material would tear during crimping of the crimp walls onto the conductor. In essence, the side walls of the transition section define a cut-out in the sides of the terminal between the terminating end and the mating end. In fact, a cut-out normally is formed between the insulation crimp walls and the conductor crimp walls so that the two pairs of walls can be crimped independently or at two different stages without tearing the sheet metal material therebetween.

One of the problems with electrical terminals as described above concerns the electrical current carrying capacity or the current flow characteristics of such terminals. Specifically, when the side walls of the terminal are cut-out or otherwise reduced in dimensions between the conductor crimp walls and the mating end of the terminal, the overall cross-sectional area of the terminal is reduced in the transition section thereof. This, in turn, reduces the current carrying capabilities of the terminal. In addition, such reduced sections of the terminal decrease the structural integrity of the terminal at that point. In fact, such terminals have a tendency to bend or deform at such transition sections.

The present invention is directed to solving these problems and satisfying a need for an electrical terminal as described above, with improved current flow characteristics.

SUMMARY OF THE INVENTION

An object, therefore, of the invention is to provide a new and improved electrical terminal adapted to be crimped onto an exposed conductor of an electrical wire, the conductor having a given cross-sectional area.

In the exemplary embodiment of the invention, the terminal is a stamped and formed sheet metal component in an elongated configuration defining a longitudinal axis. The terminal includes a mating end, a terminating end and a transition section therebetween. The terminating end has a pair of spaced crimp walls, and the transition section has a pair of spaced transition walls joining the crimp walls to the mating end of the terminal.

According to one aspect of the invention, the transition section has a minimum cross-sectional area at any given axial location of at least sixty-five percent of the given cross-sectional area of the conductor.

More particularly, the terminating end and the transition section of the terminal are generally U-shaped in cross section and include a common base wall. The crimp walls and the transition walls project from the base wall. The crimp walls have edges extending generally parallel to the base wall and are adapted to be curled into crimping engagement with the conductor in generally semi-cylindrical configurations. The transition walls have edges extending from the edges of the crimp walls to the given axial location of the transition section at an acute angle to the base wall, with the transition walls being adapted to be partially curled toward the conductor in generally semi-frusto-conical configurations.

With the structure described above, the transition section of the terminal has a current carrying capability substantially to that of the conductor of the electrical wire. The transition section is not reduced in cross-section sufficient to diminish the structural integrity of the terminal, and the terminal does not have a tendency to bend at the transition section. In essence, the simple structural concept of the invention solves all of the problems described in the "Background" above.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
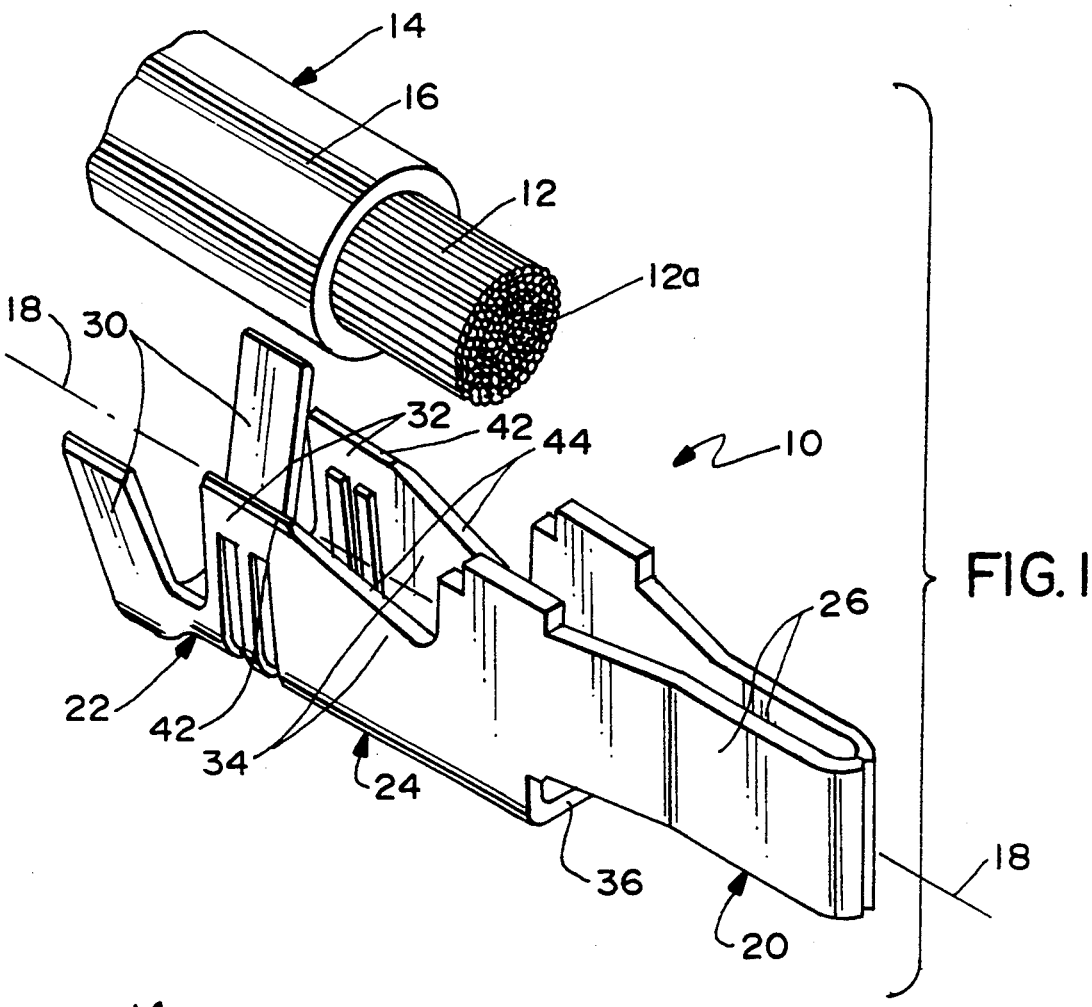
FIG. 1 is a perspective view of a terminal embodying the concepts of the invention, the terminal being in uncrimped condition, along with a depiction of a "stripped" end of an electrical wire.
Figure 2:
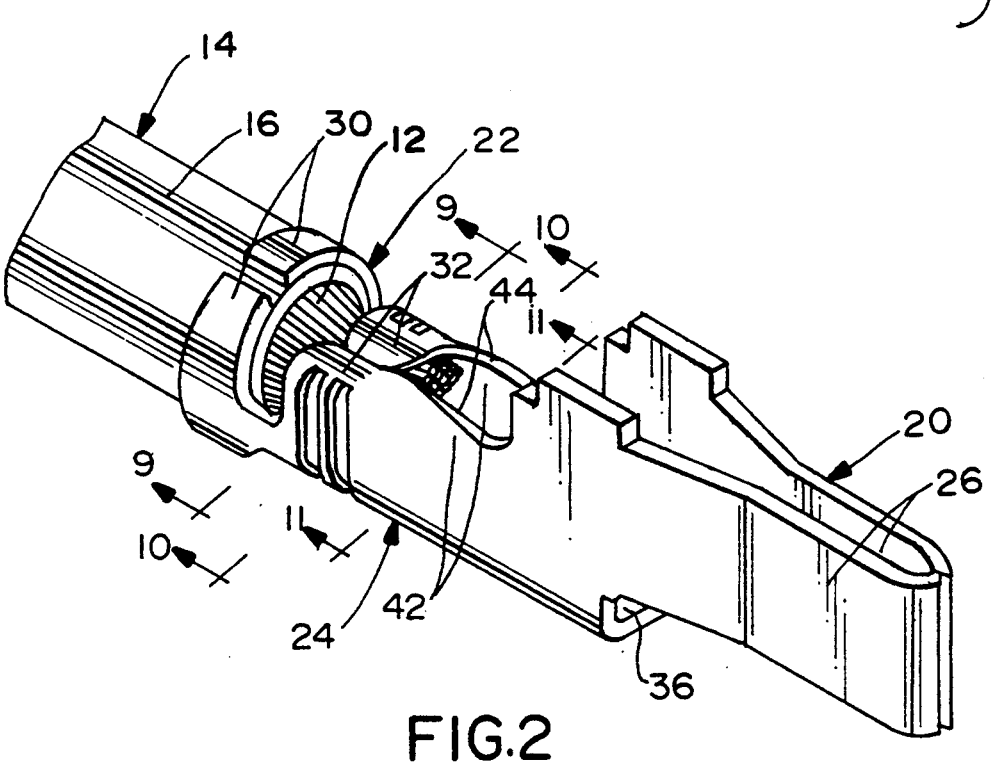
FIG. 2 is a perspective view of the terminal fully crimped onto the electrical wire.

Referring to the drawings in greater detail, and first to FIGS. 1 and 2, the invention is embodied in an elongated, stamped and formed sheet metal terminal, generally designated 10, adapted to be crimped onto an exposed conductor 12 of an electrical wire, generally designated 14. An outer cladding or sheath 16 of insulating material surrounds conductor 12. The conductor has a given cross-sectional area as defined by end 12*a* (FIG. 1).

Elongated terminal 10 defines a longitudinal axis 18 and includes a mating end, generally designated 20, a terminating end, generally designated 22, and a transition section, generally designated 24, between the mating and terminating ends.

Figure 3:
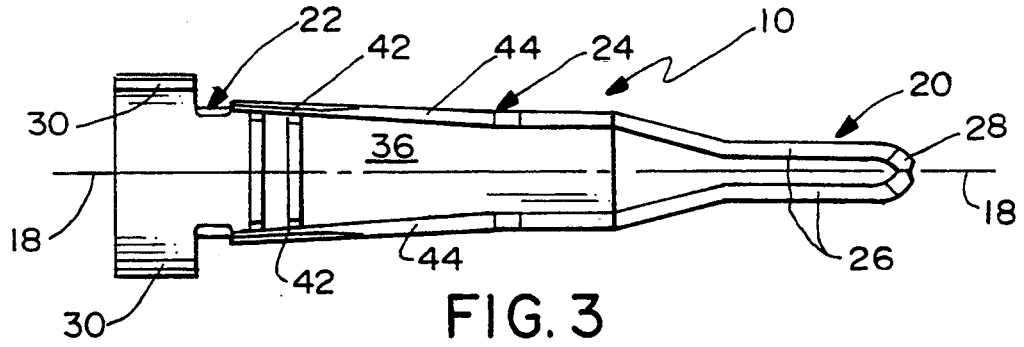
FIG. 3 is a top plan view of the terminal in uncrimped condition.
Figure 4:
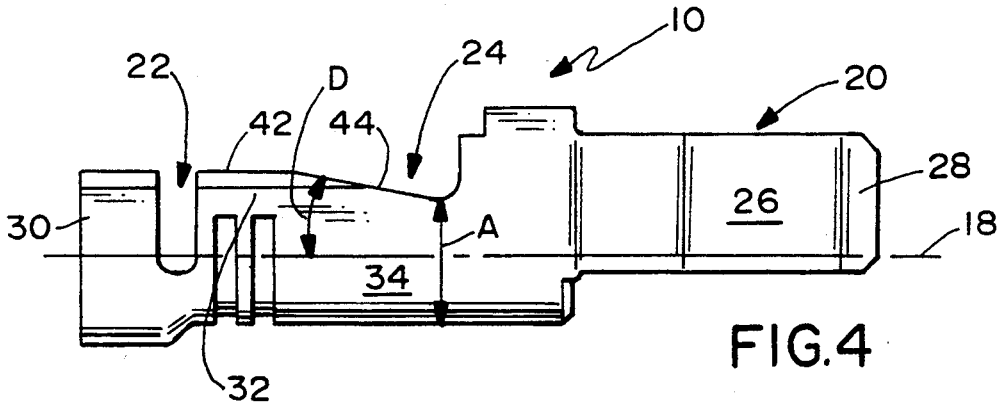
FIG. 4 is a side elevational view of the uncrimped terminal.

Referring to FIGS. 3 and 4 in conjunction with FIGS. 1 and 2, mating end 20 of terminal 10 is a male mating end as defined by a pair of juxtaposed blades 26 which are slightly spaced transversely, but which converge at a moderately pointed distal end 28 for guiding the terminal into a mating female terminal (not shown). At this point, it should be understood that the concepts of the invention relating to the terminating end and transition section of terminal 10 are equally applicable to a terminal configured to be a female terminal or to a terminal having a different type of mating end than that shown herein.

Terminating end 22 of terminal 10 includes a pair of transversely spaced insulation crimp walls 30. These crimp walls are adapted to be crimped onto insulation 16 of electrical wire 14 as shown by the crimped condition of the terminal in FIG. 2. The terminating section also includes a pair of transversely spaced conductor crimp walls 32. These crimp walls are adapted to be crimped onto exposed conductor 12 of electrical wire 14, again as shown by the crimped condition of the terminal in FIG. 2. In essence, conductor crimp walls 32 (as well as insulation crimp walls 30) are adapted to be crimped into generally semi-cylindrical configurations as seen in FIG. 2.

Figure 9:
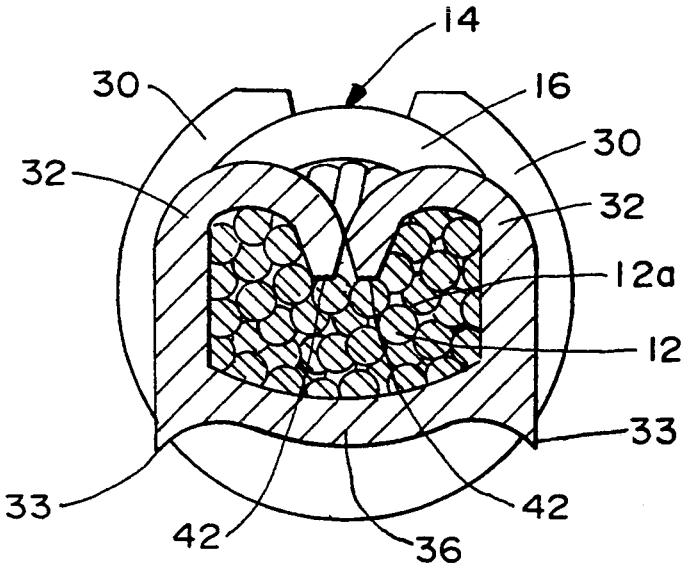
FIG. 9 is a vertical section taken generally along line 9—9 of FIG. 2.

Transition section 24 of terminal 10 includes a pair of spaced transition walls 34 joining conductor crimp walls 32 to blades 26 of mating end 20 of the terminal. Insulation crimp walls 30, conductor crimp walls 32 and transition walls 34 all project upwardly from a common base wall 36, whereby the overall configuration of the terminating end and the transition section of the terminal is generally U-shaped. As best seen in FIG. 9, after crimping, longitudinal extension points 33 are formed at the intersection of crimp wall 32 and base wall 36. These extension points serve to reinforce the conductor crimp walls preventing them from bending out of the general perpendicular relationship with the base wall.

Figure 11:
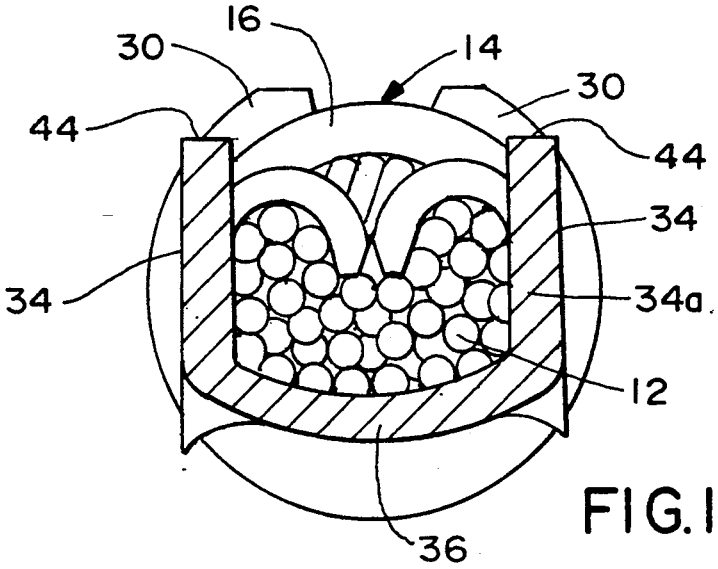
FIG. 11 is a vertical section taken generally along line 11—11 of FIG. 2.

Generally, according to one aspect of the invention, transition section 24 which joins conductor crimp walls 32 to mating end 20, has a minimum cross-sectional area 34*a*, as shown in FIG. 11, at any given axial location of at least 65% of the given cross-sectional area 12*a* of conductor 12. This given axial location is seen by the double-headed arrow "A" in FIG. 4. In other words, this location is at the narrowest dimensions of transition walls 34.

Figure 5:
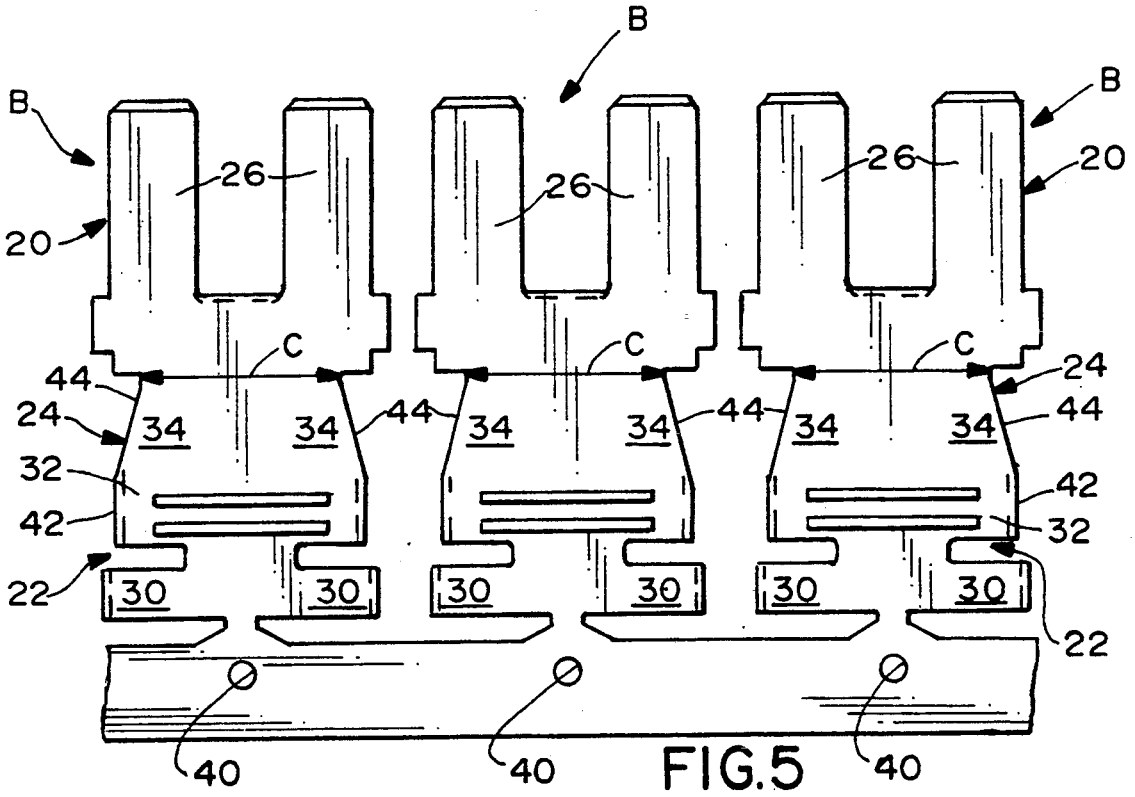
FIG. 5 is a plan view of a stamped blank of a plurality of terminals on a carrier strip, prior to being formed into their uncrimped condition.

More particularly, FIG. 5 shows three terminal blanks generally designated "B", which have been stamped from a sheet of metal material, with the blanks still joined to a carrier strip 38 having indexing holes 40, as is known in the art of stamping and forming sheet metal electrical terminals. In other words, blanks "B" in FIG. 5 have yet to be formed into the uncrimped terminals shown in FIGS. 1, 3 and 4. However, the various components of the terminal, such as mating blades 26, insulation crimp walls 30, conductor crimp walls 32 and transition walls 34 all can be seen in their relative locations in the blanks of FIG. 5. Double-headed arrow "C" is shown in FIG. 5 at the same location as double-headed arrow "A" in FIG. 4, namely at the axial location of the minimum cross-sectional area of transition section 24. With the depiction of FIG. 5, it can be understood how the cross-sectional area at the location identified by double-headed arrow "C" can be easily calculated. The metal material at this point has a thickness and a width which, according to the invention, defines a minimum cross-sectional area of at least 65% of the cross-sectional area 12*a* of conductor 12. Therefore, the current carrying capabilities of the terminal are substantially that of the conductor, itself.

From a structural standpoint, and referring to FIGS. 1, 3 and 5, conductor crimp walls 32 have upper edges 42 which extend generally parallel to longitudinal axis 18 of the terminal which, in turn, generally is the longitudinal axis of electrical wire 14 and its conductor 12. Therefore, the conductor crimp walls are curled into generally semi-cylindrical configurations into crimping engagement with conductor 12 as seen in FIG. 2.

Figure 10:
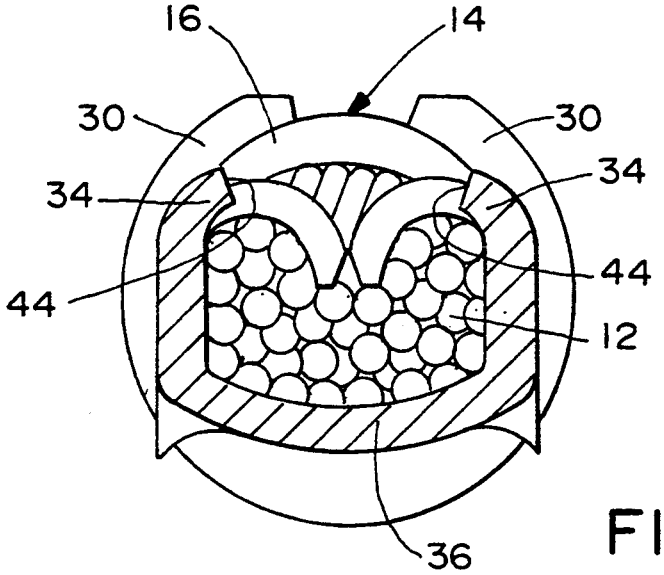
FIG. 10 is a vertical section taken generally along line 10—10 of FIG. 2.

Transition walls 34 of transition section 24 have edges 44 which extend from edges 42 of the conductor crimp walls toward the mating end of the terminal at an acute angle marked "D" in FIG. 4 of about 30° to axis 18 and base wall 36. The edges of the transition walls extend at an angle toward the axial location of the minimum cross-sectional area of the transition section, as represented by arrows "A" in FIG. 4 and "C" in FIG. 5. Therefore, transition walls 34 are adapted to be partially curled toward conductor 12 in generally semi-frustoconical configurations as seen in FIG. 2. These curled configurations of conductor crimp walls 32 and transition walls 34 also can be seen by the sectional views of FIGS. 9–11 gradually changing from a complete curl in FIG. 9 to no curl in FIG. 11 with a partial curl as shown in FIG. 10.

Figure 6:
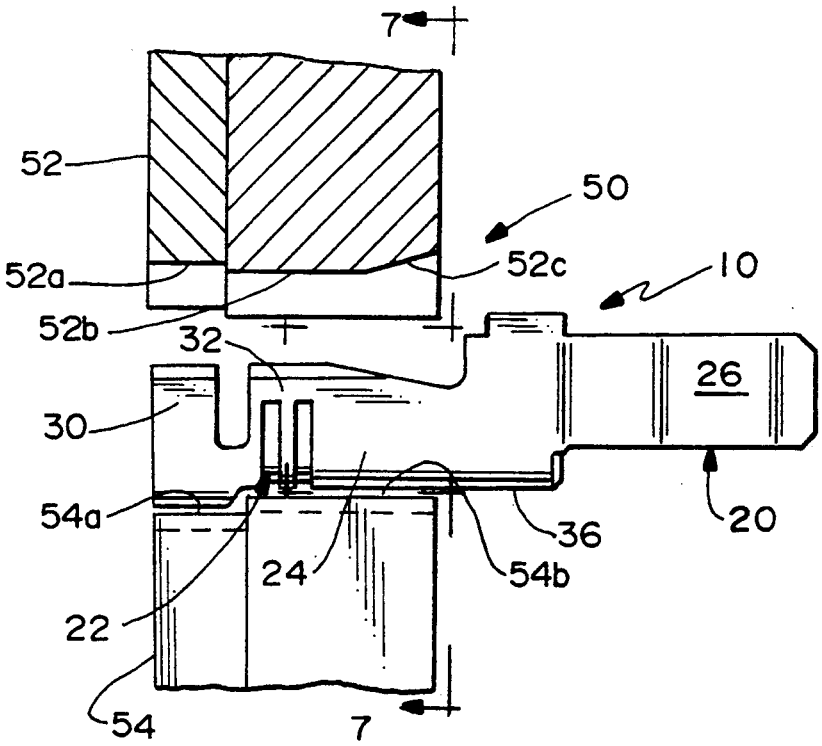
FIG. 6 is a side elevational view of the uncrimped terminal between the jaws of an appropriate crimping tool.
Figure 7:
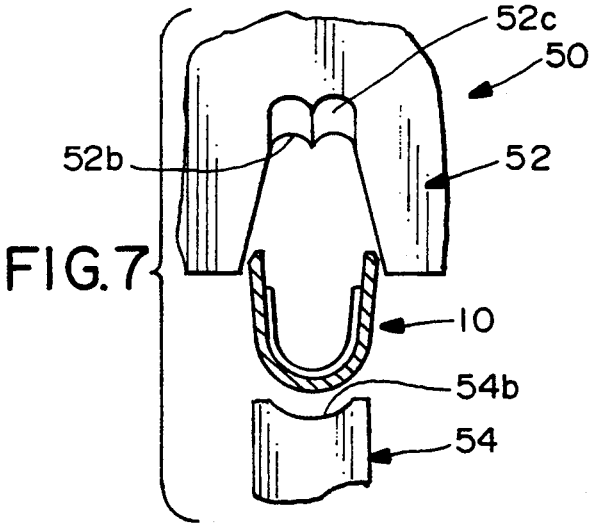
FIG. 7 is a side elevational view looking toward the right side of FIG. 6, with a section through the terminal.
Figure 8:
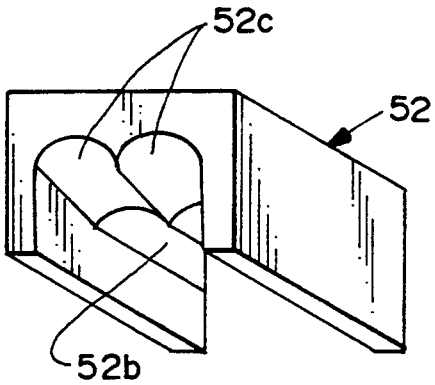
FIG. 8 is a perspective view looking toward the underside of the upper jaw of the crimping tool.

FIGS. 6–8 show a crimping tool, generally designated 50 (FIG. 6), which is designed for crimping insulation crimp walls 30, conductor crimp walls 32 and transition walls 34 of terminal 10. More particularly, one of the terminals is shown in FIG. 6 positioned between a pair of jaws defined by an upper press die, generally designated 52, and a lower anvil means, generally designated 54. The anvil means includes a first portion 54*a* for backing insulation crimp walls 34 and a second portion 54*b* for backing conductor crimp walls 32 and transition walls 34.

Upper press die 52 has a first section 52*a* which has a downward die configuration of an inverted "W" as is known in the art for crimping insulation crimp walls 30 into generally semi-cylindrical configurations onto insulation 16 of electrical wire 14 as seen in FIG. 2. Similarly, upper press die 52 has a second portion 52*b* which faces downwardly in a generally inverted "W" cross-section and is formed for crimping conductor crimp walls 32 into generally semi-cylindrical configurations in engagement with conductor 12, again as seen in FIG. 2.

However, upper press die 52 of crimping tool 50 has a unique third portion or section 52*c* which, at any given axial point, also has an inverted "W" configuration in cross-section. However, the third portion 52*c* of the upper press die tapers outwardly or flares away from the portion 52*b* which crimps conductor crimp walls 32, in order to partially crimp transition walls 34 toward the conductor. In essence, as seen best in FIG. 8, the third portion 52*c* of the upper crimp die defines a pair of adjacent semi-frusto-conical surfaces 56 which form the upper edges 44 of the transition walls into their unique semi-frusto-conical configurations.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an elongated sheet metal terminal adapted to be crimped onto an exposed conductor of an electrical wire, the conductor having a given cross-sectional area, the terminal defining a longitudinal axis and including a mating end, a terminating end and a transition section therebetween, the terminating end having a pair of spaced crimp walls, and the transition section having a pair of spaced transition walls joining the crimp walls to the mating end, wherein the improvement comprises said transition section having a cross-sectional area perpendicular to said longitudinal axis gradually diminishing from the terminating end to the mating end with a minimum cross-sectional area of the transition section at any given axial location thereof of at least sixty-five percent of said given cross-sectional area of the conductor;

wherein said terminating end and said transition section are generally U-shaped in cross section and include a common base wall, with said crimp walls and said transition walls projecting from the base wall; and wherein said crimp walls have upper edges extending generally parallel to said base wall and are adapted to be curled into crimping engagement with the conductor, and said transition walls have edges extending from the edges of the crimp walls to said given axial location of the transition section at an acute angle to the base wall and adapted to be partially curled toward the conductor.

2. In an elongated sheet metal terminal as set forth in claim 1, wherein the transition walls are adapted to be curled into generally semi-frusto-conical configurations toward the conductor.

3. In an elongated sheet metal terminal adapted to be crimped onto an exposed conductor of an electrical wire, the terminal defining a longitudinal axis and including a mating end, a terminating end and a transition section therebetween, the terminating end including at least one crimp wall, and the transition section including at least one transition wall, the walls being generally parallel to said axis, wherein the improvement comprises said crimp wall having an edge extending generally parallel to said axis, with the crimp wall being adapted to be curled into a generally semi-cylindrical configuration into crimping engagement with the conductor, the transition wall having an edge extending from the edge of the crimp wall toward the mating end at an acute angle to said axis, with the transition wall being adapted to be curled into a generally semi-frusto-conical configuration toward the conductor.

4. In an elongated sheet metal terminal adapted to be crimped onto an exposed conductor of an electrical wire, the terminal defining a longitudinal axis and including a mating end, a terminating end and a transition section therebetween, the terminating end including at least one crimp wall, and the transition section including at least one transition wall, the walls being generally parallel to said axis, wherein the improvement comprises said crimp wall having a structural configuration adapted to be curled into crimping engagement with the conductor, and said transition wall having a structural configuration adapted to be partially curled toward the conductor, whereby both the crimp wall and the transition wall can be simultaneously crimped to avoid tearing the sheet metal therebetween;

wherein said terminating end and said transition section are generally U-shaped in cross section and include a common base wall, with said crimp wall and said transition wall projecting from the base wall; and wherein said crimp wall has an upper edge extending generally parallel to said base wall and is adapted to be curled into crimping engagement with the conductor, and said transition wall has an edge extending from the edge of the crimp wall to axial location of the transition section having a minimum cross-sectional area at an acute angle to the base wall and is adapted to be partially curled toward the conductor where the curl in the transition wall gradually diminishes from a complete curl which is in the crimp wall to no curl at all at said axial location.

* * * * *